US007220077B2

(12) United States Patent
Humphries et al.

(10) Patent No.: US 7,220,077 B2
(45) Date of Patent: May 22, 2007

(54) TRAFFIC NOISE BARRIER SYSTEM

(75) Inventors: Eric C. Humphries, Moodus, CT (US); Stephen D. Barratt, Long Valley, NJ (US); Ronald K. Faller, Lincoln, NE (US); Keith J. Kurz, Grand Island, NE (US); Dean L. Sicking, Lincoln, NE (US)

(73) Assignees: CYRO Industries, Parsippany, NJ (US); Board of Regents of the University of Nebraska, Lincoln, NE (US)

( * ) Notice: Subject to any disclaimer, the term of this patent is extended or adjusted under 35 U.S.C. 154(b) by 0 days.

(21) Appl. No.: 11/100,100

(22) Filed: Apr. 5, 2005

(65) Prior Publication Data

US 2005/0265780 A1 Dec. 1, 2005

Related U.S. Application Data

(60) Provisional application No. 60/559,738, filed on Apr. 6, 2004.

(51) Int. Cl.
*E01F 15/00* (2006.01)
*E01F 13/00* (2006.01)

(52) U.S. Cl. ..... 404/6

(58) Field of Classification Search ..... 404/6, 404/9; 256/13.1

See application file for complete search history.

(56) References Cited

U.S. PATENT DOCUMENTS

| | | | | | |
|---|---|---|---|---|---|
| 2,193,747 | A * | 3/1940 | Thompson | ..... | 116/175 |
| 3,388,892 | A * | 6/1968 | Case | ..... | 256/13.1 |
| 4,111,401 | A * | 9/1978 | Pickett | ..... | 256/13.1 |
| 4,214,411 | A * | 7/1980 | Pickett | ..... | 52/144 |
| 4,685,656 | A * | 8/1987 | Lee et al. | ..... | 256/13.1 |
| 5,186,438 | A * | 2/1993 | Cross et al. | ..... | 256/13.1 |
| 5,406,039 | A * | 4/1995 | Rerup et al. | ..... | 181/210 |
| 6,305,492 | B1 * | 10/2001 | Oleiko et al. | ..... | 181/210 |

* cited by examiner

*Primary Examiner*—Raymond Addie
(74) *Attorney, Agent, or Firm*—Gregory S. Rosenblatt; Wiggin and Dana LLP

(57) ABSTRACT

A crashworthy traffic noise barrier system for use alongside a path of traffic, the crashworthy traffic noise barrier system comprises a crashworthy longitudinal barrier extending substantially parallel to the path of traffic and a crashworthy traffic noise barrier wall supported by the longitudinal barrier. The crashworthy traffic noise barrier wall includes a plurality of upstanding posts attached to the traffic noise barrier wall, at least one panel supported between each adjacent pair of posts in the plurality of upstanding posts, and at least one longitudinal beam spaced above a top surface of the longitudinal barrier and extending across the plurality of upstanding posts for redirecting a portion of an errant vehicle away from the at least one panel. The longitudinal beams redirect energy of the errant vehicle away from the panels such that the panels and any fragments of the panels, remain attached to the traffic noise barrier wall. The panels may be transparent and may be reinforced with plastic bands, plastic threads, or a plastic net.

22 Claims, 8 Drawing Sheets

TRAFFIC NOISE BARRIER SYSTEM

CROSS-REFERENCE TO RELATED APPLICATIONS

The present application claims the benefit of U.S. Provisional Patent Application No. 60/559,738 filed Apr. 6, 2004 and entitled "Traffic Noise Barrier System", which is incorporated by reference herein in its entirety.

BACKGROUND OF THE INVENTION

1. Field of the Invention

This invention relates to traffic noise barriers. More specifically, this invention relates to a crashworthy traffic noise barrier system for bridge rails and other longitudinal barriers.

2. Description of the Related Art

Traffic noise barrier walls serve to shield otherwise quiet areas from noise caused by automotive, railway, aircraft, marine, or pedestrian traffic. A typical traffic noise barrier wall is from about 4 to 24 feet in height and runs continuously alongside a selected section of a roadway, railway, aircraft runway, waterway, parking lot, walkway, and the like.

One common design of a traffic noise barrier wall includes a plurality of panels of wood or concrete supported by vertically mounted posts. Examples of such noise barrier walls are found in U.S. Pat. Nos. 5,713,170 and 5,537,788, both issued to Elmore et al. Noise barrier walls of this type are suitably sturdy and effective in reducing highway noise; however, such noise barrier walls are usually not designed for vehicle impact. As a result, these noise barriers are located many feet (e.g., 40 feet) from the normal path of traffic. Problematically, space constraints often require that noise barriers be located closer to the path of traffic. One example is when a noise barrier is required on a bridge.

Where space constraints exist, it is not uncommon for noise barriers to be mounted on top of a crashworthy traffic barrier. One example of such an arrangement is found in U.S. Pat. No. 4,214,411 issued to Pickett, wherein panels of transparent material are secured between beams mounted on top of a roadside barrier. The transparent panels are effective in providing travelers on the traffic path with a view outside the roadway. However, vehicles impacting the otherwise crashworthy traffic barrier may also strike the noise barrier, creating potential hazards to the impacting vehicle and nearby pedestrians.

The U.S. Federal Highway Administration (FHWA) requires all longitudinal barriers used on the National Highway System (NHS) to be crashworthy and to qualify as such according to the testing and acceptance guidelines of the National Cooperative Highway Research Program (NCHRP) Report No. 350, which is incorporated by reference herein in its entirety. Under NCHRP Report No. 350, longitudinal barriers include any device whose primary functions are to prevent vehicular penetration and to safely redirect an errant vehicle away from a hazard outside the normal path of the vehicle (e.g., outside the roadway). Longitudinal barriers include, for example, roadside barriers, median barriers, and bridge rails. For longitudinal barriers, NCHRP Report No. 350 defines six test levels, each of which prescribe test conditions appropriate for a range of highway types, traffic volumes, and other parameters. Test Level 1 (TL-1) and Test Level 2 (TL-2) are intended for low-speed and/or low-volume roads, while Test Level 3 (TL-3) through Test Level 6 (TL-6) are intended for high-speed facilities with increasingly higher traffic volumes. TL-1, TL-2, and TL-3 require redirection of an 820-kg car impacting a barrier at 20 degrees, and a 2,000-kg pickup truck impacting a barrier at 25 degrees, at speeds of 50 km/h, 70 km/h, and 100 km/h, respectively. TL-4 adds an 8,000-kg single-unit truck at 15 degrees and 80 km/h to the TL-3 matrix; TL-5 substitutes a 36,000-kg tractor/van trailer for the single-unit truck. TL-6 substitutes a 36,000-kg tractor/tank trailer. Thus, to be used on the NHS, a longitudinal barrier must be accepted by the FHWA as meeting one or more test levels of NCHRP 350. Such acceptance is typically indicated in a letter from the FHWA to the manufacturer of the longitudinal barrier or in a published memo from the FHWA.

Although NCHRP Report No. 350 offers guidance for the safety performance evaluation of longitudinal and other traffic barriers, it offers no guidance toward the evaluation of attachments on or near these barriers. Some guidance toward the evaluation of barrier attachments to barriers is provided in a technical paper entitled "Guidelines for Attachments to Bridge Rails and Median Barriers" by Keller et al. Using the Test Levels outlined in NCHRP Report No. 350, Keller et al. identify a "Zone of Intrusion" (ZOI) for a wide variety of traffic barriers, including sloped-face concrete parapets (e.g., New Jersey, Single Slope, F-shape, and open concrete rail), vertical-faced concrete parapets (e.g., vertical wall and open concrete rail), steel corrugated rails (e.g., W-beam and thrie beam), steel tubular rails, steel tubular rails on curbs, combination concrete and steel tube railings, and timber bridge rails. The ZOI represents an envelope around the barrier into which various vehicular components intrude upon the vehicle's impact with the barrier.

For noise barriers and similar attachments, referred to by Keller et al. as "continuous attachments", Keller et al. provide various design considerations that allow such attachments to be placed in the ZOI. One suggestion is to use attachments that will breakaway, allowing the system to deflect upon impact by a vehicle. Where non-breakaway attachments are used, Keller et al. suggest that the design take into account the snag potential of the attachment. Snagging is when a portion of a vehicle engages a vertical element, such as a post, causing deceleration of the vehicle. In addition to snagging concerns, Keller et al. suggest that the potential implications of debris from impacts on these systems be considered because debris associated with the attachment may fall on traffic and/or pedestrians around or below the barrier. Keller et al. also suggest that vehicle occupant compartment intrusion and deformation be considered. Occupant compartment intrusion and deformation is a concern for traffic barrier attachments under two scenarios: (1) a vehicle component is driven into the occupant compartment due to impact with the attachment; or (2) the attachment itself intrudes into or deforms the occupant compartment. While Keller et al. provide various guidelines for the design of barrier attachments, Keller et al. fail to provide a design for a traffic noise barrier wall that would meet their guidelines.

Thus, there is a need for a traffic noise barrier wall for use where space constraints require the noise barrier wall to be located near a selected section of a roadway, railway, aircraft runway, waterway, parking lot, walkway, and the like, and which will prevent vehicle deceleration due to snagging, will reduce or eliminate occupant compartment intrusion and deformation, and which will reduce or eliminate falling debris concerns.

BRIEF SUMMARY OF THE INVENTION

The above-described and other needs are met by a traffic noise barrier system for use alongside a path of traffic. The traffic noise barrier system comprises a longitudinal barrier extending substantially parallel to the path of traffic, and a traffic noise barrier wall supported by the longitudinal barrier. The traffic noise barrier wall includes: a plurality of upstanding posts attached to the traffic noise barrier wall; a plurality of panels supported by the plurality of upstanding posts; and at least one longitudinal beam extending across the plurality of upstanding posts for redirecting a portion of an errant vehicle away from the plurality of panels. The at least one longitudinal beam may include a first longitudinal beam spaced above the longitudinal barrier and disposed between the path of traffic and the plurality of panels, and a second longitudinal beam spaced above the first longitudinal beam and disposed between the path of traffic and the plurality of panels.

The panels may be disposed between each pair of adjacent posts. One or more of the panels may be transparent, and one or more of the panels may be reinforced with plastic bands, plastic threads, or a plastic net. The plastic threads may be high-contrast plastic threads, the high-contrast plastic threads having sufficient contrast to be recognized by birds flying in the vicinity of the panel and causing no substantial impairment of the overall transparency of the panel. Each panel in the plurality of panels may have a rigid frame disposed around at least a portion of its perimeter.

A rear support beam may be disposed on an opposite side of the panel from the first longitudinal beam, and a front support beam may be attached to the first longitudinal beam, between the first longitudinal beam and the panel Resilient members may be disposed between the front support beam and the panel and between the rear support beam and the panel. The longitudinal beam may be formed from a plurality of axially aligned sections.

A horizontal centerline of the first longitudinal beam is preferably spaced a distance between about 32 inches to about 44 inches above a terrain surface, and more preferably at 38 inches above the terrain surface. A horizontal centerline of the second longitudinal beam is preferably spaced a distance between about 44 inches to about 74 inches above the terrain surface, and more preferably 60 inches above the terrain surface. The longitudinal barrier may be qualified under National Cooperative Highway Research Program Report No. 350 Test Level 3.

In another embodiment, a third longitudinal beam is disposed between the path of traffic and the plurality of panels. The third longitudinal beam extends across the plurality of upstanding posts and is spaced above the second longitudinal beam. A horizontal centerline of the third longitudinal beam is preferably spaced a distance between about 100 inches to about 154 inches above the terrain surface, and more preferably about 128 inches above the terrain surface. The longitudinal barrier may be qualified under National Cooperative Highway Research Program Report No. 350 Test Level 4. In one embodiment, the longitudinal barrier has a height greater than or equal to 40 inches above the terrain surface and the first longitudinal beam is omitted.

Each of the upstanding posts may have a flange extending along substantially an entire height of the upstanding post. The flange extends generally parallel to the panel and forms a gap between opposing, generally parallel surfaces of the flange and the panel. Preferably, the gap is less than or equal to about ½ inch. In one embodiment, an anti-intrusion wedge is disposed within the gap.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION

Figure 1:
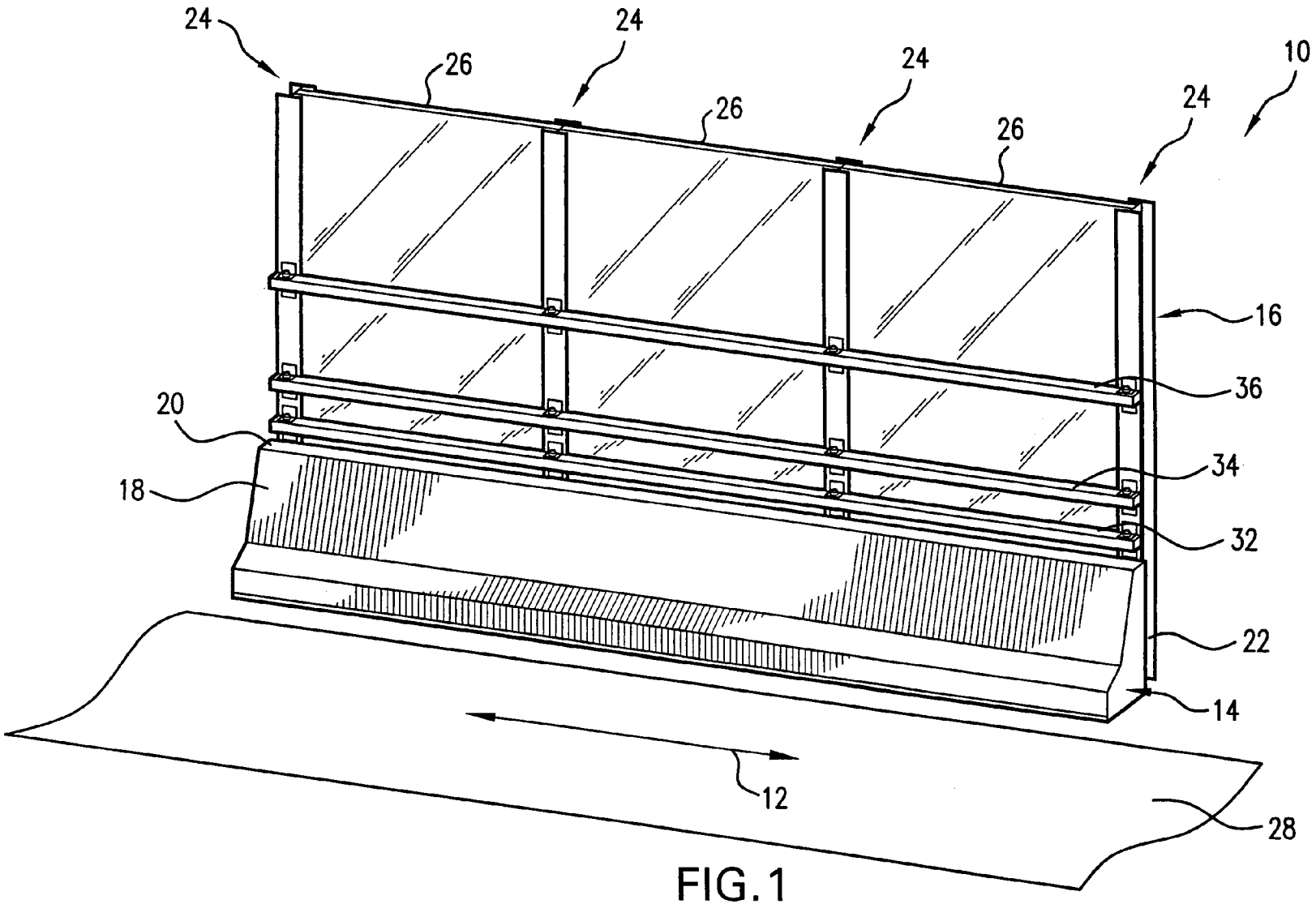
FIG. 1 is a perspective view of a crashworthy traffic noise barrier system of the present invention.
Figure 2:
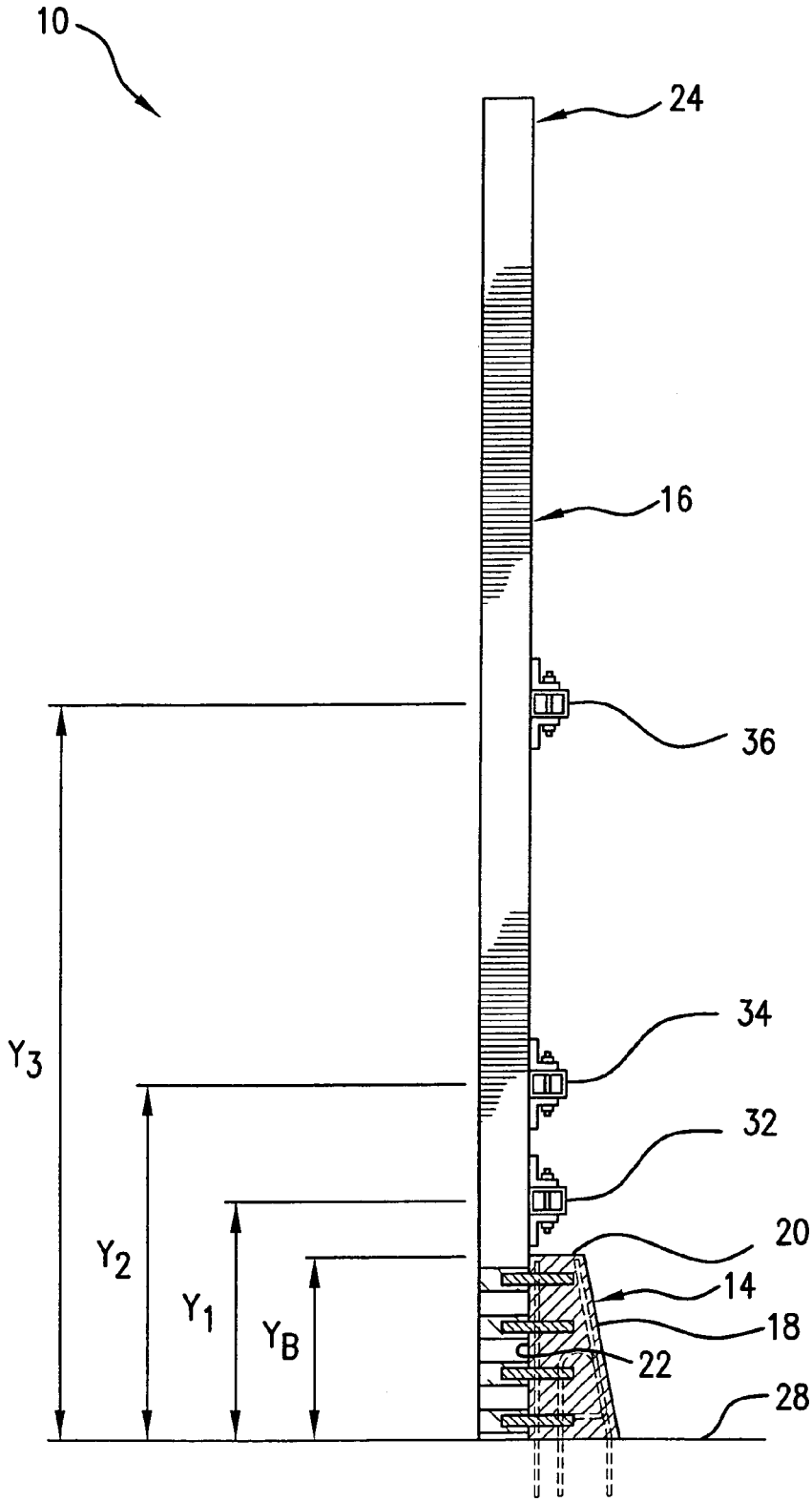
FIG. 2 is a side elevation view of the crashworthy traffic noise barrier system.
Figure 3:
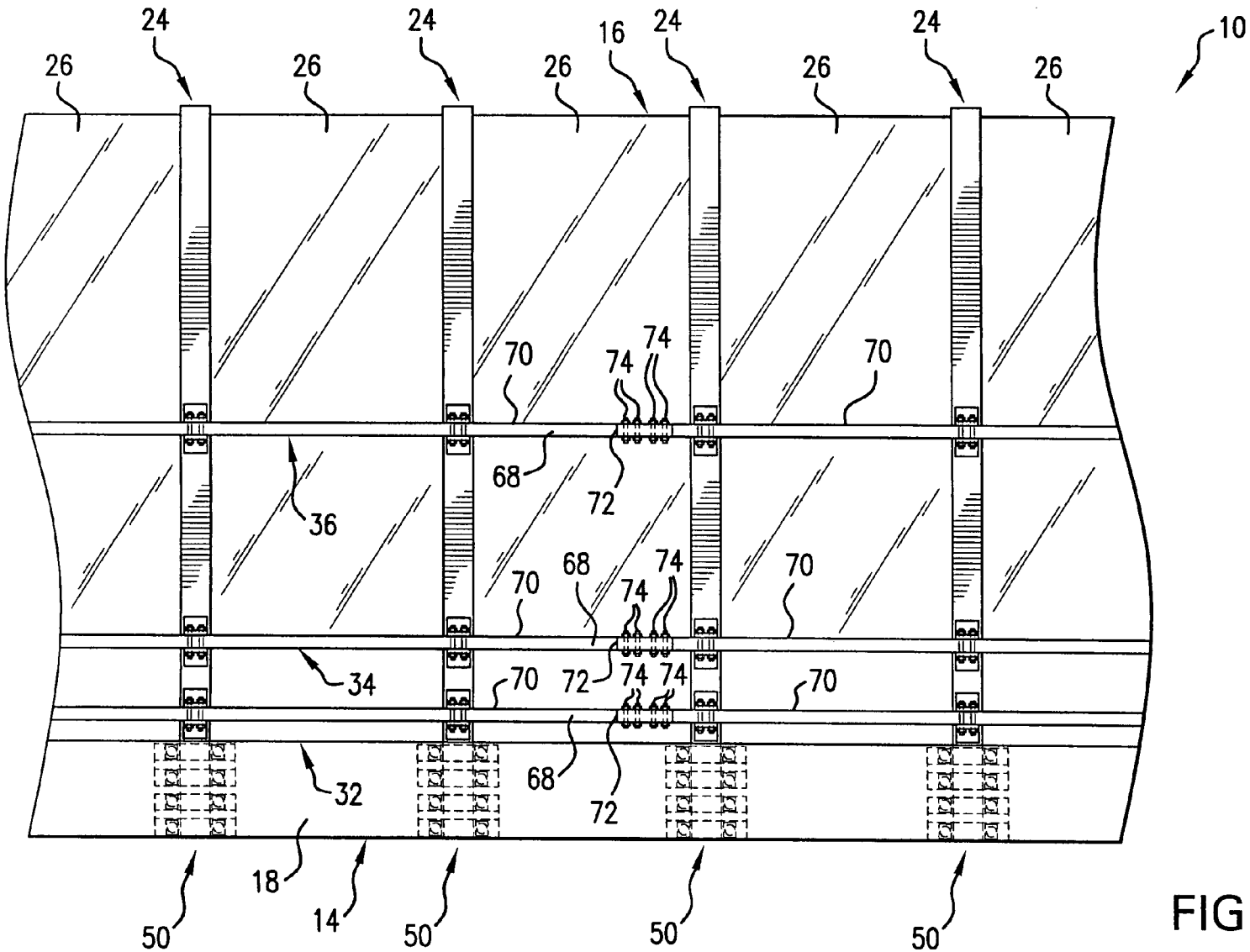
FIG. 3 is a front elevation view of the crashworthy traffic noise barrier system.

Referring to FIGS. 1 through 3, a traffic noise barrier system 10 for use alongside a path of traffic 12 is shown. FIG. 1 is a perspective view of the system 10, FIG. 2 is a side elevation view of the system 10, and FIG. 3 is front elevation view of the system 10. The path of traffic 12 may be a roadway, railway, aircraft runway, waterway, parking lot, walkway, bridge and the like. The traffic noise barrier system 10 includes a longitudinal barrier 14 and a traffic noise barrier wall (noise wall) 16 supported by the longitudinal barrier 14. The longitudinal barrier 14 may be any barrier extending longitudinally along at least a portion of the path of traffic 12. For example, the longitudinal barrier 14 may include one or more parapets, median barriers, bridge railings, and the like. The longitudinal barrier 14 includes a front surface 18 facing the path of traffic 12, a top surface 20 adjacent to the front surface 18, and a back surface 22 opposite the front surface 18. In the present embodiment, the traffic noise barrier wall 16 is attached to the back surface 22.

The traffic noise barrier wall 16 includes spaced-apart, upstanding posts 24 having panels 26 extending between each pair of posts 24. In the embodiment shown, one panel 26 is disposed between each pair of posts 24, however, it is contemplated that one or more panels 26 may be disposed between each pair of posts 24. The noise barrier wall 16 has a height above a terrain surface 28 of the path of traffic 12 that is appropriate for the particular application of the wall 16. For example, the height of the noise barrier wall 16 may be from about 4 to 18 feet, depending on the noise abatement requirements of the wall 16.

Each panel 26 is made from an acoustically absorptive and/or reflective material that is appropriate for the individual application of the traffic noise barrier wall 16. For example, the panels 26 may be made of a transparent material where it is desired that travelers on the path of traffic 12 have a view through the wall 16. One example of a preferred transparent material for use as a panel 26 is PARAGLAS SOUNDSTOP® Noise Barrier Sheet commercially available from CYRO Industries, 100 Enterprise Drive, Rockaway, N.J. Where transparency is not desired, other materials such as wood, steel, opaque acrylic, plastic, and the like, may be used. The panel 26 may be corrugated for added strength.

Figure 4:
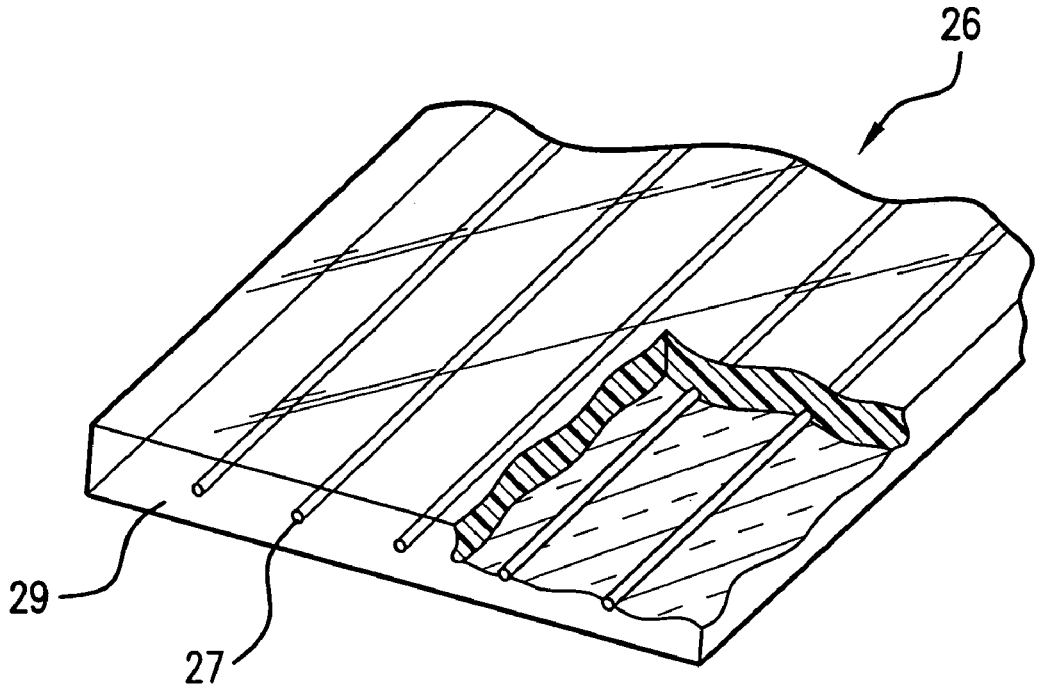
FIG. 4 is a perspective view of a portion of a panel in the crashworthy traffic noise barrier system.
Figure 5:
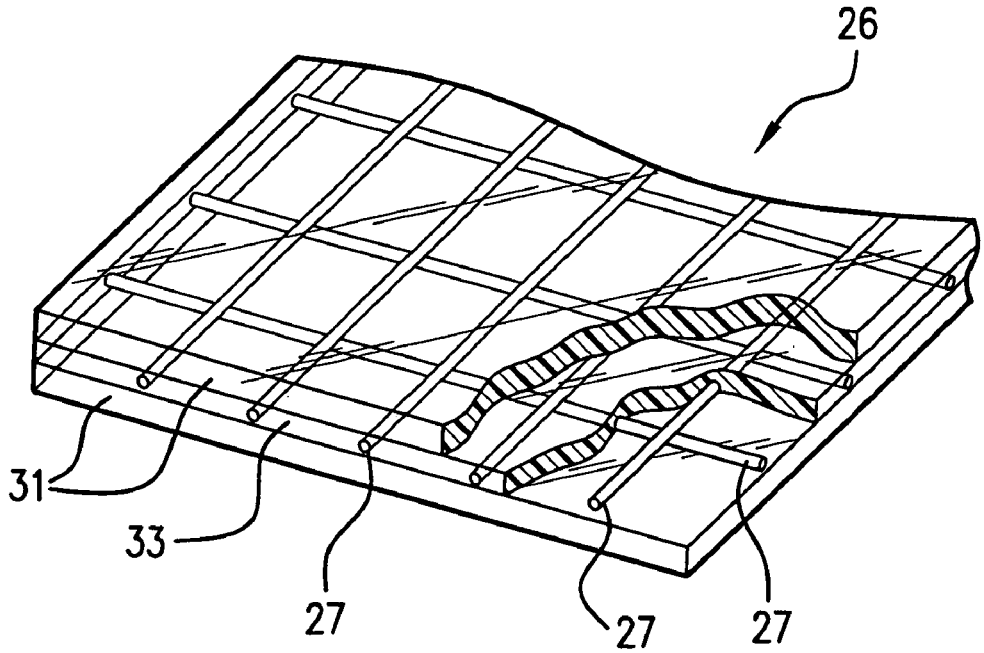
FIG. 5 is a perspective view of a portion of an alternative panel in the crashworthy traffic noise barrier system.

Referring to FIG. 4, the panel 26 may also be reinforced with threads, bands, a net, or the like, as indicated at 27, which in the event that the panel breaks, will hold the pieces of the panel 26 together. Noise Barrier Sheet panels reinforced with threads are commercially available from the aforementioned CYRO Industries. For example, one or more of the panels 26 may be a transparent polymer panel having spaced parallel faces and containing plastic threads, plastic bands, or a plastic net embedded approximately midway between the parallel faces and extending parallel to the faces, as described in U.S. Pat. No. 5,040,352 issued Aug. 20, 1991 to Oberlander et al., which is incorporated by reference herein in its entirety. As shown in FIG. 4, the embedded plastic threads or bands 27 may run parallel to each other in one direction. FIG. 5 depicts an alternative panel 26 wherein the plastic threads or bands 27 run parallel to each other in two directions. It will be appreciated that the embodiment of FIG. 5 may be accomplished using a net.

Referring to FIG. 4, the panel 26 may be a cast acrylic glass panel 29 in which plastic threads are embedded. The plastic threads 27 are parallel to each other and are approximately midway between the faces of the panel 26. Alternatively, referring to FIG. 5, the panel 26 can be manufactured using two acrylic glass panels 31 connected to one another by an intermediate layer 33. The plastic threads 27 are embedded in the intermediate layer 33 approximately in the middle. The intermediate layer 33 may be formed from a cold-hardening methacrylate resin.

Where the panels 26 include plastic threads 27, these threads 27 may be high-contrast so that they can be recognized by birds flying in the vicinity of the panel while causing no substantial impairment of the overall transparency of the panel 26, as described in U.S. Pat. No. 5,372,866 issued Dec. 13, 1994 to Oberlander et al., which is incorporated by reference herein in its entirety. The term "high contrast", as used herein, refers to plastic which has a transmission ratio between 0 and 65% (measured according to DIN 5033 (colorimetry) and 5036 (radiometric and photometric properties of materials)). Preferably, the material or the actual plastic thread 27 has a transmission ratio of 0 to 30%, more particularly 0 to 10%. A transmission ratio of about 0% is particularly advantageous. To obtain contrast also, the plastic thread 27 must stand out from the background, e.g., by having a different color. Metal-coated threads are unsuitable for this purpose if, for example, they reflect the sky in front of the panel against the sky behind the panel or give undesired reflexes or reflections, e.g. of the sun. It is advantageous to use dark threads, particularly black threads. Owing to the high-contrast of the threads, flying birds can recognize the transparent panel 26 as an obstacle before they fly into it, and while they are a few meters away, and can fly around the panel 26.

In particularly advantageous embodiments, the plastic threads 27 are 1 mm to 5 mm thick. More particularly the thickness range from 1.8 to 3.0 mm, preferably 2.0 to 2.5 mm, has been found particularly advantageous with regard to the required properties, i.e. easy insertion into the panel 26, sufficient strength in the event of a fracture, sufficient visibility to birds and no substantial impairment of the overall transparency of the panel 26.

The threads 27 in the panel 26 may extend horizontally, since the panels 26 are clamped at their sides; in that case the cohesion in the event of a fracture is particularly advantageous. The threads 27 may be laid parallel to one another. If desired or necessary, two layers of threads 27 can be incorporated in the panel 26 and will then preferably extend in two directions, an angle of 90° between threads 27 of different layers being particularly advantageous.

Usually, the distance between neighboring threads 27 is not greater than 100 mm, since greater distances markedly decreases the protection of birds or the prevention of fragmentation. Preferably, the distance between threads 27 is up to 50 mm, particularly when the threads 27 are horizontal, since birds appear to recognize horizontal obstacles less easily than vertical obstacles.

The surface density of the threads 27, i.e. the percentage of the surface of the entire panel 26 which is covered by the threads 27 (the surface density), is usually from about 2.5 to about 25%. Preferably, particularly in the case of horizontal threads 27, the surface density is at least about 5%, particularly advantageously about 6 to about 10%. In the case of vertical threads 27, the surface density can be slightly less, so that, in this case, the advantageous range is from 5 to 8%. Below this surface density, the bird-protecting effect is rapidly lost, whereas above these values the threads 27 remain visible at a greater distance and detract from the appearance, i.e. the advantageous transparency of the plastic panel 26 is largely wasted.

Typical panel 26 thicknesses are preferably about 4 to about 40 millimeters, and more preferably 12 to 25 mm. The panels 26 are usually manufactured in sizes of 2×2.5 meters to 2×5 meters. Larger or smaller sizes are possible for special uses.

The panels 26 are usually substantially transparent, preferably colorless or slightly tinted, e.g. smoky brown. Colorless transparent plastic panels 26 usually have a transmission ratio of at least 70%. A ratio of about 90 to about 95% is advantageous. Tinted embodiments usually have a transmission ratio of about 45 to about 75%, for example between about 50 and about 60%. The absorption of the threads 27 and of the tinted panel 26 is cumulative, so that the threads 27 are additionally recognizable as high-contrast elements.

In the embodiments of FIGS. 1-3, the longitudinal barrier 14 is shown as a slope-faced concrete parapet commonly known as a Jersey barrier. It is contemplated, however, that any known kind of barrier may be used, including other sloped-face concrete parapets (e.g., Single Slope, F-shape, and open concrete rail), vertical-faced concrete parapets (e.g., vertical wall and open concrete rail), steel corrugated rails (e.g., W-beam and thrie beam), steel tubular rails, steel tubular rails on curbs, combination concrete and steel tube railings, and timber bridge rails.

Extending across the posts 24 are one or more longitudinal beams 32, 34 and 36. The longitudinal beams 32, 34 and 36 extend generally parallel to the top surface 20 of the longitudinal barrier 14 and generally perpendicular to the upstanding posts 24. In the embodiment shown, the posts 24 are formed from steel I-beams and longitudinal beams 32 are formed from steel tubes, respectively. It will be appreciated, however, that other rigid materials or structures may also be used. For example, the beams 32 or posts 24 may be formed from other metals (e.g., aluminum), fiberglass, and the like, and may be formed from a composite of materials. The beams 32 or posts 24 may be of any convenient cross sectional shape, such as for example: rounded (e.g., oval, ovoid, or round), I-beams, H-beams, channel beams, substantially flat, polygonal (e.g., triangular, quadrilateral (e.g., square, rectangular), pentagonal, hexagonal, heptagonal, octagonal, etc.).

The longitudinal beams 32, 34 and 36 are configured to redirect portions of an errant vehicle that may intrude into the area above the top surface 20 of the longitudinal barrier away from the panels 26. The longitudinal beams 32, 34, and 36 redirect energy of the errant vehicle away from the panels 26 such that the panels 26 and any fragments of the panels, remain attached to the traffic noise barrier wall 16. As shown in FIG. 2, the horizontal centerline of the first beam 32 is spaced a distance y1 from the terrain surface 28, the horizontal centerline of the second beam 34 is spaced a distance y2 from the terrain surface 28, and the horizontal centerline of the third beam 36 is spaced a distance y3 from the terrain surface 28. Preferably, y1 is between about 32 inches to about 44 inches and more preferably at about 38 inches. Preferably, y2 is between about 44 inches to about 74 inches and more preferably at about 60 inches. Preferably, y3 is between about 100 inches to about 154 inches and more preferably at about 128 inches.

The heights of y1, y2 and y3 are selected so that the corresponding longitudinal beams 32, 34 and 36 will impact different portions of an errant vehicle intruding into the area above the top surface 20 of the longitudinal barrier. Beam 32 is positioned at the height y1 to contact the lower portion (e.g., hood and upper fender) of the vehicle (e.g., a single-unit truck for TL-4 and a ¾ ton pickup truck for TL-3), beam 34 is positioned at the height y2 to contact the occupant compartment of the vehicle, and beam 36 is positioned at y3 to contact a box portion of a vehicle such as a single-unit truck. Where the height of the traffic noise barrier wall 16 is less than that required to achieve this spacing (e.g., less than about 100 inches), the distances y1 and y2 are preferably maintained within the ranges provided, and the third beam 36 is placed at or near the top of the noise barrier wall 16.

Figure 6:
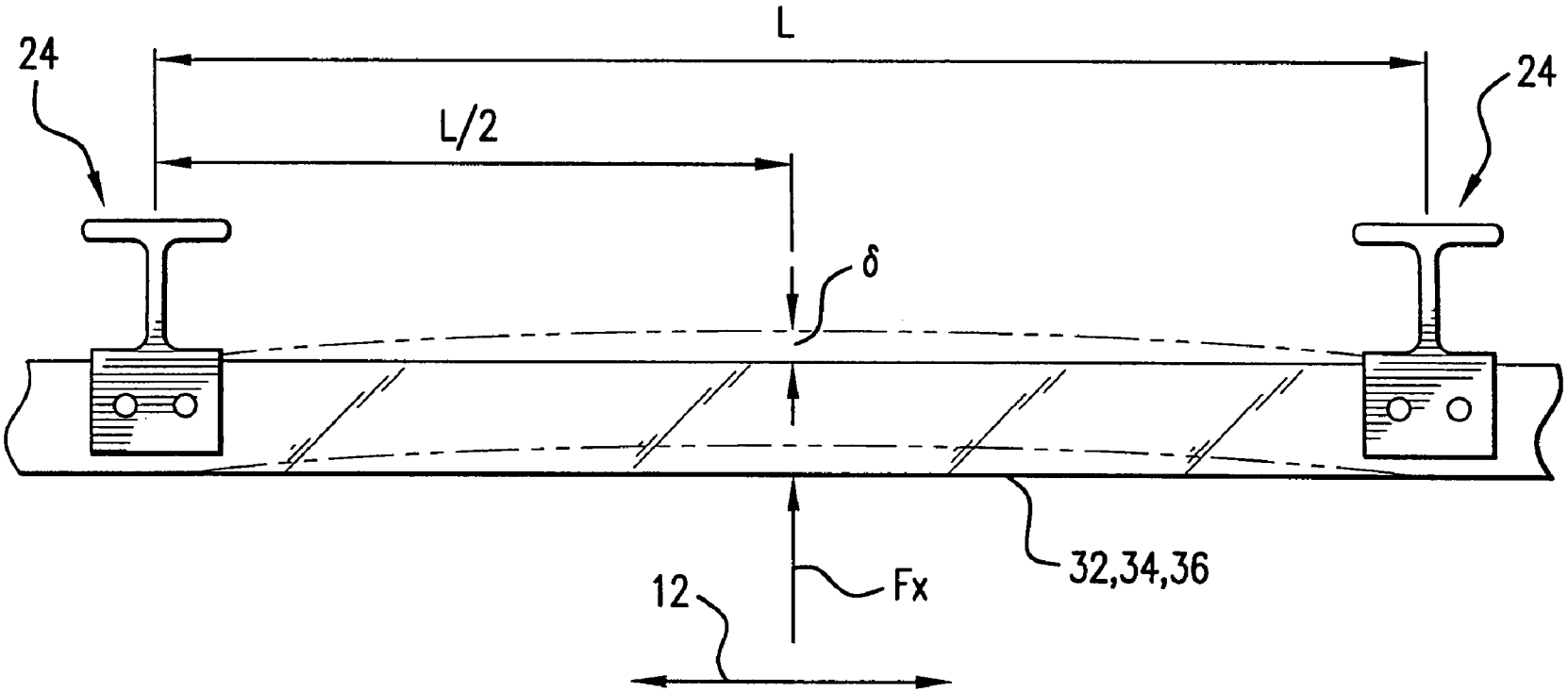
FIG. 6 is a plan view of longitudinal beams and upstanding posts showing a deflection of the longitudinal beam under a load applied normal to the longitudinal beam at a point mid span between the upstanding posts.

Referring to FIG. 6, the beams 32, 34 and 36 and posts 24 are designed to withstand, without breakage, a force F, which corresponds to the characteristics of traffic (e.g., speed of traffic, size of vehicles, number of vehicles, etc.) that will travel along the path of traffic 12. It has been determined that in applications requiring the system 10 to be qualified under Test Level 4 of the NCHRP Report 350 and where the beams 32, 34, and 36 are formed from steel, the first longitudinal beam 32 may be sized to deflect no more than about ½ inch under a force of 25 kips (1 kip=1000 pounds) applied in a direction away from the path of traffic and normal to the first longitudinal beam 32 at a point mid span (L/2) between two adjacent upstanding posts 24. The second longitudinal beam 34 may be sized to deflect no more than about ½ inch under a force of 15 kips applied in a direction away from the path of traffic 12 and normal to the second longitudinal beam 34 at a point mid span (L/2) between the two adjacent upstanding posts 24; and the third longitudinal beam may be sized to deflect no more than about ½ inch under a force of 15 kips applied in a direction away from the path of traffic 12 and normal to the third longitudinal beam 36 at a point mid span (L/2) between the two adjacent upstanding posts 24. It has been determined that by minimizing the deflection δ under these forces, the potential for breakage of the panels 26 and the potential for the errant vehicle snagging a post 24 are reduced. While no more than about ½ inch deflection δ for each of the beams 32, 34, and 36 under their respective loads is preferred, it is believed that deflections δ of between about ¼ inch to about 6 inches under these loads are acceptable.

In any case, the force F and deflection δ to which the one or more beams (e.g., 32, 34, and/or 36) are designed are chosen to ensure that the longitudinal beams withstand an impact of 55 kips, which is typical of a collision caused by an 8000 kg single unit truck striking at an angle of 15 degrees relative to a line parallel to the barrier. Withstanding a collision with an 8000 kg single unit truck is a requirement of NCHRP Report 350 Test Level 4. It is contemplated that the one or more longitudinal beams may be of any shape, configuration or material that meets this design requirement. It is also contemplated that the beams 32, 34, 36 could be replaced with multiple beams in approximately the same locations so long as, together, they meet the same requirements. As previously noted, each beam 32, 34, 36 is designed to deflect either a certain part of a vehicle or a certain type of vehicle. For instance, the first beam 32 is designed to contact the lower portion (e.g., hood and upper fender) of a single-unit box truck, the second beam 34 is designed to contact the occupant compartment of the single-unit box truck, and the third beam 36 is designed to capture the top portion of the container of the single-unit box truck. This then dictates the height of the beams 32, 34, 36 and load capability that the beams 32, 34, and 36 must withstand. It is also contemplated that different forces F and deflections δ can be incorporated into the design to meet other test criteria.

Also in applications requiring the system 10 to be qualified under Test Level 4 of the NCHRP Report No. 350, the upstanding posts 24 are preferably designed to withstand a load of 55 kips, applied as 25 kips on the first beam 32 and 15 kips each on the second and third beams 34, 36, without separating from the longitudinal barrier 14 and without fracturing the upstanding posts 24.

In applications requiring the system 10 to be qualified under Test Level 3 of the NCHRP Report No. 350, it has been determined that only the first and second beams 32 and 34 are needed and the third beam 36, may be removed. It has also been determined that in applications requiring the system 10 be qualified under Test Level 3 of the NCHRP Report No. 350 and where the beams 32 and 34 are formed from steel, the first longitudinal beam 32 may be sized to deflect no more than about ½ inch under a force of 10 kips applied in a direction away from the path of traffic 12 and normal to the first longitudinal beam 32 at a point mid span (L/2) between two adjacent upstanding posts 24; and the second longitudinal beam 34 may be sized to deflect no more than about ½ inch under a force of 10 kips applied in a direction away from the path of traffic 12 and normal to the second longitudinal beam 34 at a point mid span (L/2) between the two adjacent upstanding posts 24. It has been determined that by minimizing the deflection δ under these forces, the potential for breakage of the panels 26 and the potential for the errant vehicle snagging a post 24 are reduced. While no more than about ½ inch deflection δ for each of the beams 32 and 34 under their respective loads is preferred, it is believed that deflections δ of between about ¼ inch to about 6 inches under these loads are acceptable.

In any case, the force F and deflection δ to which the one or more beams (e.g., 32 and/or 34) are designed are chosen to ensure that the longitudinal beams withstand an impact of 10 kips, which is typical of a collision caused by ¾ ton pickup truck having a weight of 2000 kg at an angle of 25 degrees relative to a line parallel to the barrier. Withstanding a collision with a ¾ ton pickup truck having a weight of 2000 kg is a requirement of NCHRP Report 350 Test Level 3. It is contemplated that the one or more longitudinal beams may be of any shape, configuration or material that meets this design requirement. It is also contemplated that the beams 32, 34 could be replaced with multiple beams in approximately the same locations so long as, together, they meet the same requirements. As previously noted, each beam 32, 34 is designed to deflect either a certain part of a vehicle or a certain type of vehicle. For instance, the first beam 32 is designed to contact the lower portion (e.g., hood and upper fender) of a ¾ ton pickup truck, and the second beam 34 is designed to contact the occupant compartment of the ¾ ton pickup truck. This then dictates the height of the beams 32, 34 and load capability that the beams 32, 34 must withstand. It is also contemplated that different forces F and deflections δ can be incorporated into the design to meet other test criteria.

Also in applications requiring the system 10 to be qualified under Test Level 3 of the NCHRP Report No. 350, the upstanding posts 24 are preferably designed to withstand a load of 10 kips, without separating from the longitudinal barrier 14 and without fracturing the upstanding posts 24.

Referring again to FIGS. 1-3, the configuration of longitudinal beams 32, 34 and 36 allow the noise barrier wall 16 to be positioned close to traffic (e.g., against the back surface 22 of the longitudinal barrier 14 as shown in FIG. 2), while minimizing the possibility that the panels 26 will break due to impact by an errant vehicle and while preventing the snagging of the errant vehicle on the upstanding posts 24. This is particularly advantageous in applications, such as on bridges and the like, where space for the noise barrier wall 16 is limited. It will be appreciated that where sufficient space behind the longitudinal barrier 14 is available, the noise barrier wall 16 may be spaced apart from the back surface 22 of the longitudinal barrier 14 as described in co-pending U.S. patent application Ser. No. 10/718,022, entitled "TRAFFIC NOISE BARRIER SYSTEM" and filed on 19 Nov. 2003, which is incorporated by reference herein in its entirety.

Figure 7:
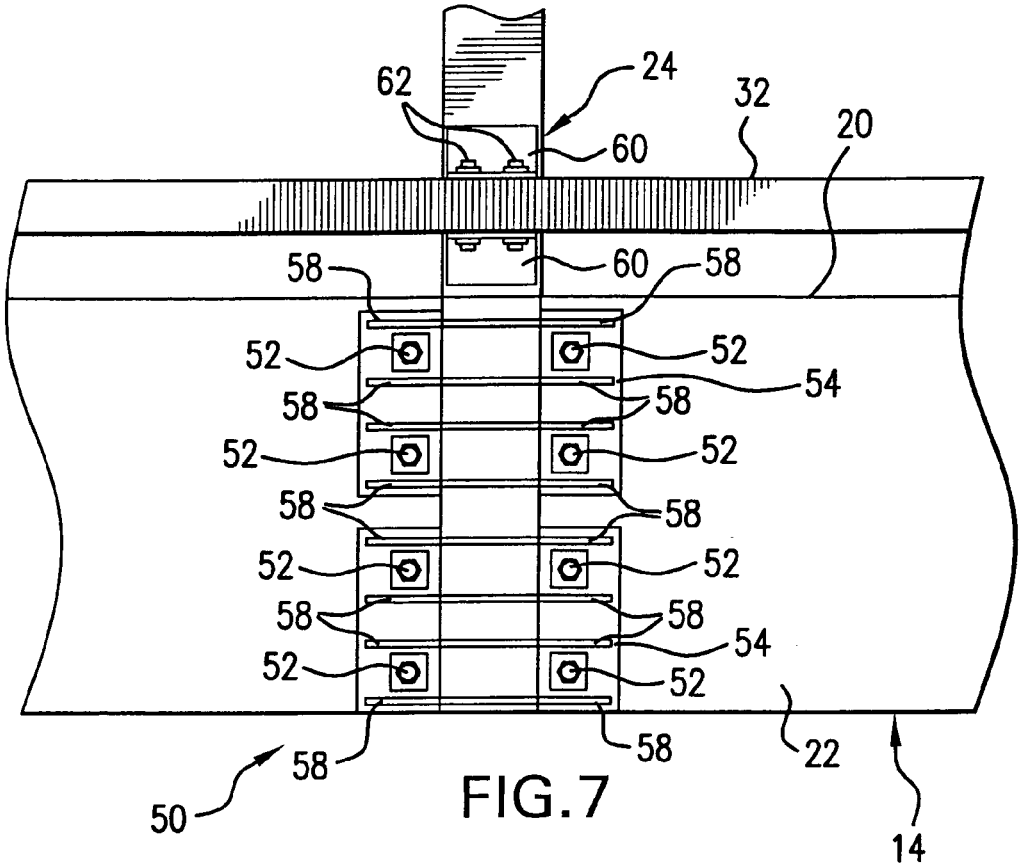
FIG. 7 is a rear elevation view of a post connected to a longitudinal barrier in the traffic noise barrier system.
Figure 8:
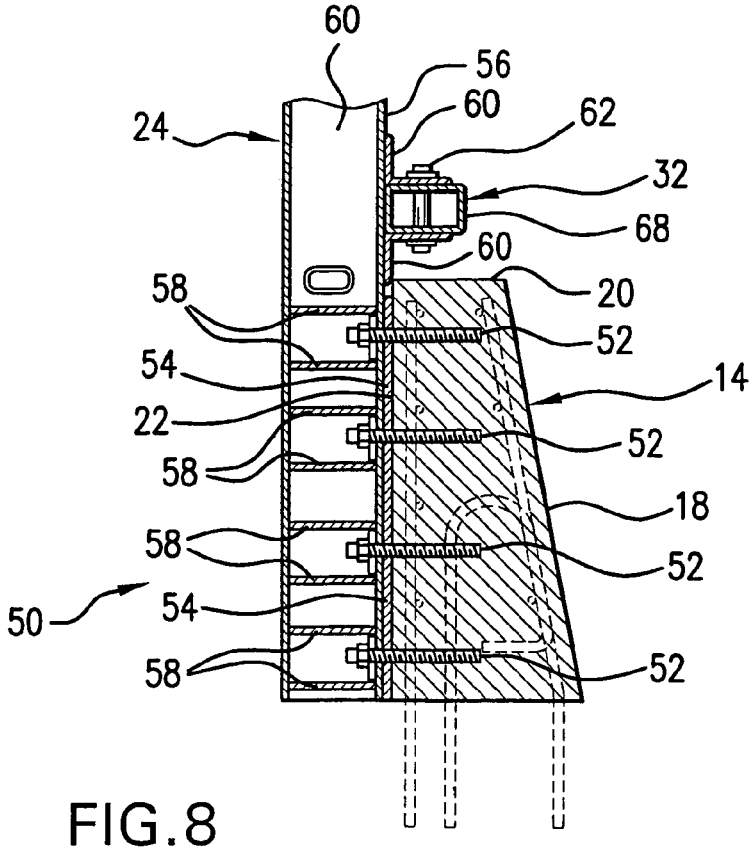
FIG. 8 is a cross-sectional elevation view of the post connected to a longitudinal barrier in the traffic noise barrier system.

Referring to FIGS. 7 and 8, the upstanding posts 24 may be connected to the longitudinal barrier 14 using a bolted assembly 50. In the bolted assembly 50, plurality of bolts 52 are secured within the longitudinal barrier 14. A free end of the bolts 52 extends outward from the back surface 22 of the longitudinal barrier 14 and through apertures disposed in a pair of plates 54. The plates 54 extend coplanar with the back surface 22 of the longitudinal barrier 14, and are secured to the longitudinal barrier 14 by way of washers and nuts, which are threaded to the free end of the bolts 52. The upstanding post 24, which is an I-beam in this embodiment, is secured to the plate 54 by welding or otherwise fastening to a flange portion 56 of the upstanding post 24. A plurality of support members 57 extend outward from a web portion 60 of the upstanding post 24 to the plate 54. The upstanding posts 24, as well as the remainder of the noise barrier wall 16, may be supported entirely by the longitudinal barrier 14. That is, the longitudinal barrier 14 carries the entire weight of the noise barrier wall 16 such that the noise barrier wall 16 is suspended above ground. Alternatively, the noise barrier wall 16 may be supported in part by the longitudinal barrier 14. For example, the ends of the posts 24 may rest on the ground, bridge structure, or the like, with the longitudinal barrier providing support to hold the noise barrier 14 wall 16 in an upright position.

As also shown in FIGS. 7 and 8, the longitudinal beam 32 may be secured to the upstanding post 24 by L-shaped brackets 60, which are disposed on the top and bottom sides of the longitudinal beam 32. In the embodiment shown, the L-shaped brackets 60 are welded or otherwise fastened to the upstanding posts 24, and one or more bolts 62 are disposed through the L-shaped brackets 60 and the longitudinal beam 32 to secure the longitudinal beam 32 between the L-shaped brackets 60. Longitudinal beams 34 and 36 (e.g., FIG. 1) may be secured to the upstanding posts 24 using the same arrangement.

Referring to FIG. 3, the length of the noise barrier wall may exceed the length of each section 70 of material (e.g., metal tube) used to form the longitudinal beam 32, 34 or 36. In this case, the sections 70 of material forming each longitudinal beam 32, 34 or 36 are preferably axially aligned and joined in butt-to-butt fashion. This method of joining the sections 70 maintains a substantially planar face 68 along the longitudinal beam 32, 34 or 36 towards the path of traffic 12 and, as a result, reduces the possibility of an errant vehicle snagging a portion of the longitudinal beam 32, 34 or 36. For example, adjacent sections 70 of the longitudinal beam 32, 34 or 36 may be joined by disposing a rigid insert 72 within the hollow ends of each section 70 and securing the rigid insert 72 to each section 70 by disposing bolts 74 through each section 70 and through the rigid insert 72, as shown in FIG. 3.

Figure 9:
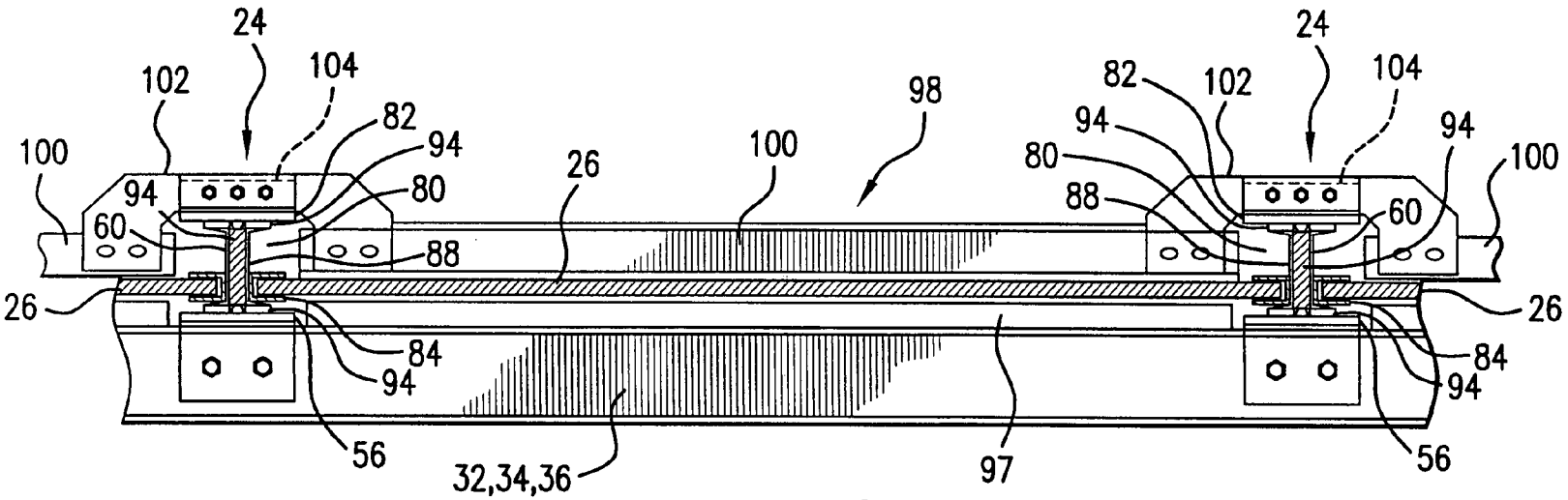
FIG. 9 is a plan view of an embodiment of the traffic noise barrier system including panel support features.
Figure 10:
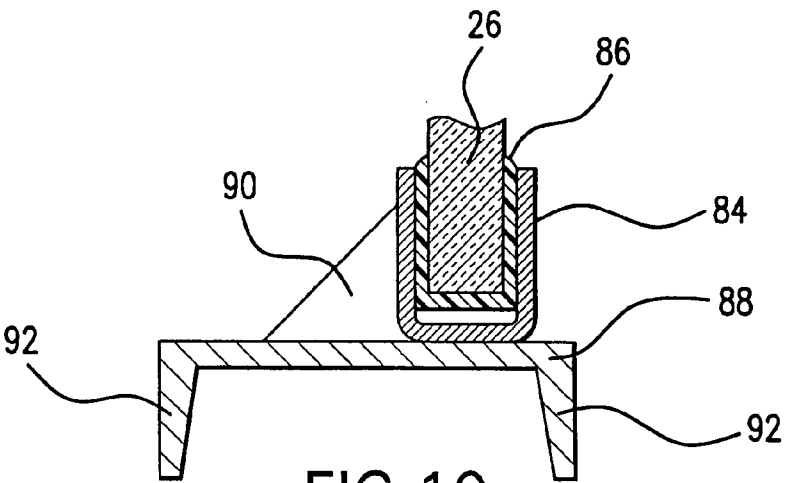
FIG. 10 is a cross-sectional plan view of a portion of a panel support frame.

FIGS. 9 and 10 provide a plan view of a portion of the noise barrier wall 16 showing a method of securing panels 26 between upstanding posts 24. While FIGS. 9 and 10 show one method of securing panels 26 between upstanding posts 24, it will be appreciated that other methods may also be used. For example, panels 26 may be disposed between posts 24 as described in U.S. patent application Ser. No. 10/777,442 filed Feb. 12, 2004 and entitled "Panel Assembly for Traffic Noise Barrier Wall", which is incorporated by reference herein in its entirety.

As shown in FIG. 9, side edges of the panels 26 are secured within channels 80, which extend along the length of the posts 24. Each channel 80 is formed between the first flange 56 of the I-beam post 24, and a second flange 82, which is secured to the web 60 of the I-beam. Each panel 26 is positioned proximate the first flange 56 of the post 24 to reduce a gap formed between opposing, generally parallel surfaces the first flange 56 and the panel 26. Minimizing this gap reduces the potential for a portion of a vehicle from wedging in this gap as the vehicle strikes the panel 26 and post 24 during impact and, thereby, prevents vehicle snagging, excessive vehicle deceleration, and redirection of the vehicle. Preferably, the gap formed between the opposing, generally parallel surfaces the first flange 56 and the panel 26 is no greater than about ½ inch.

Figure 11:
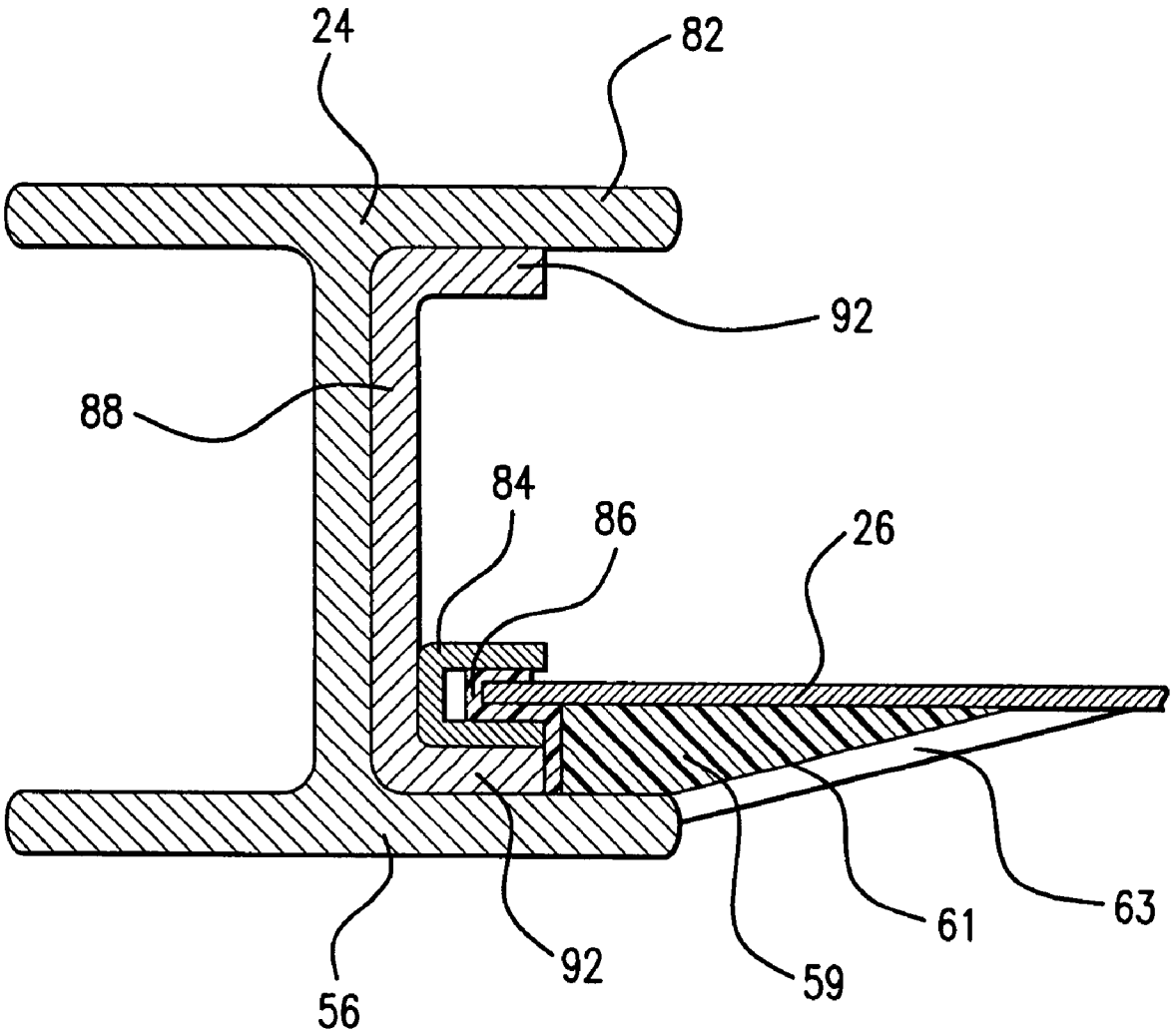
FIG. 11 is a cross-sectional plan view of an anti-intrusion wedge disposed between a post and a panel.

In addition to minimizing the gap formed between the opposing, generally parallel surfaces the first flange 56 and the panel 26, or where the gap is greater than about ½ inch, an anti-intrusion wedge 59 may be disposed between the post 24 and the panel 26, as shown in FIG. 11. The anti-intrusion wedge 59 is a wedge-shaped structure that extends substantially along the entire height of the post 24, and fills the gap formed between the opposing, generally parallel surfaces the first flange 56 and the panel 26. The anti-intrusion wedge 59 may be formed from a resilient material (e.g., Ethylene Propylene Diene Monomer (EPDM)

strips, rubber strips, plastic strips, and the like). The anti-intrusion wedge 59 has a sloped face 61 that extends from the first flange 56 to the panel 26, and may include a rigid plate 63 (e.g., a metal plate) adhered to the sloped face 61. The anti-intrusion wedge 59 prevents a portion of a vehicle striking the post 24 and panel 26 from entering the gap formed between the opposing, generally parallel surfaces the first flange 56 and the panel 26, and thereby prevents vehicle snagging, excessive vehicle deceleration, and redirection of the vehicle.

Referring again to FIGS. 9 and 10, disposed along the side edges of each panel 26 is a frame 84, which has a generally U-shaped cross section. The frame 84 captures the side edges of the panel 26, and preferably extends along the entire length of the side edge of the panel 26. Optionally, the frame 84 captures the entire perimeter of the panel 26 to enhance rigidity of the panel 26. A resilient gasket 86 may be disposed between the frame 84 and the panel 26.

The portions of the frame 84 disposed on the side edges of the panel 26 are each attached to channel beams 88, which have a generally C-shaped cross section. Support members 90 may be attached between the frame 84 and the channel beam 88 to enhance structural rigidity, as shown in FIG. 10. Each channel beam 88 includes flange portions 92, which are arranged to extend either towards the panel 26, as shown in FIG. 11, or away from the panel 26, as shown in FIG. 10. The distance between the outer surfaces of the flange portions 92 is less than the distance between the inner surfaces of the flange portions 56 and 82 of the upstanding post 24, allowing the channel beams 88 to be received in the channel 80 formed in the upstanding post 24. Resilient gaskets 94 may be disposed between the channel beams 88 and the upstanding posts 24 to secure the channel beams 88, and thus the frame 84 and panel 26, between the upstanding posts 24.

Referring to FIG. 9, attached to a side of any one or more of the longitudinal beams 32, 34, 36 facing the panel 26 is a front support beam 97. The front support beam 97 extends generally parallel to the longitudinal beams 32, 34, or 36 and bridges a gap between the longitudinal beam 32, 34, or 36 and the panel 26. In the embodiment shown, the front support beam 97 is formed by a rigid tube. In addition, a rear support beam 98 may be positioned on an opposite side of the panel 26 from any one or more of the longitudinal beams 32, 34, 36, with the rear support beam 98 extending parallel to the associated longitudinal beam 32, 34 or 36. In the embodiment shown, the rear support beam 98 includes a plurality of rigid tubes 100, each being disposed between a pair of adjacent posts 24 and each having a face disposed proximate an associated panel 26. The rigid tubes 100 on opposite sides of each post 24 are supported by a generally U-shaped plate 102, which extends around the post 24. The U-shaped plate 102 is attached to the post 24 by a generally L-shaped bracket 104, which is secured to an outer surface of the flange 82 of the post 24. The rear support beam 98 and the front support beam 97 support the panel 26 against various loads such as, for example, wind loads, to prevent bending of the panel 26 and dislodging of the panel 26 from the frame 84. Where the rear support beam 98 and the front support beam 97 are formed from a rigid material, resilient members (e.g., Ethylene Propylene Diene Monomer (EPDM) strips, rubber strips, plastic strips, and the like) may be disposed between the panel 26 and the front and rear support beams 97, 98 to prevent the panel from contacting the rigid material forming the front and rear support beams 97, 98.

The traffic noise barrier system 10 provides a traffic noise barrier wall 16 supported by a longitudinal barrier 14, which can be located near a selected section of a roadway, railway, aircraft runway, waterway, parking lot, walkway, and the like. The longitudinal beams 32, 34 and 36 are configured to redirect portions of an errant vehicle that may intrude into the area above the top surface 20 of the longitudinal barrier away from the panels 26. The longitudinal beams 32, 34, and 36 redirect energy of the errant vehicle away from the panels 26 such that the panels 26 and any fragments of the panels, remain attached to the traffic noise barrier wall 16. As a result, the longitudinal beams 32, 34 and 36 prevent debris that would otherwise present a hazard to the occupants of the vehicle, surrounding traffic, and/or pedestrians around or below the barrier. In addition, the longitudinal beams 32, 34 and 36 prevent an errant vehicle from snagging on the upstanding posts 24. As a result, the noise barrier wall 16 may be positioned close to traffic, while reducing or eliminating the vehicle snagging, occupant compartment intrusion and deformation, and debris concerns associated with traffic noise barriers of the prior art. This is particularly advantageous in applications, such as on bridges and the like, where space for the noise barrier wall is limited. In addition, the traffic noise barrier system 10 allows the use of transparent panels 26, which allow travelers on the path of traffic 12 to view businesses and scenery outside the path of traffic 12. Also, the use of reinforced panels 26 helps to further ensure that the panels 26 will not become a debris hazard or vehicle intrusion hazard.

A number of embodiments of the present invention have been described. Nevertheless, it will be understood that various modifications may be made without departing from the spirit and scope of the invention. Accordingly, other embodiments are within the scope of the following claims.

What is claimed is:

1. A traffic noise barrier system for use alongside a path of traffic, the traffic noise barrier system comprising:

a longitudinal barrier extending substantially parallel to the path of traffic; and a traffic noise barrier wall supported by the longitudinal barrier, the traffic noise barrier wall including:

a plurality of upstanding posts attached to the traffic noise barrier wall, a plurality of panels supported by the plurality of upstanding posts, and at least one longitudinal beam extending across the plurality of upstanding posts, the at least one longitudinal beam is spaced above the longitudinal barrier and disposed between the path of traffic and the plurality of panels for redirecting a portion of an errant vehicle away from the plurality of panels.

2. The traffic noise barrier system of claim 1, wherein at least one of the panels is disposed between each pair of adjacent posts.

3. The traffic noise barrier system of claim 1, wherein the at least one longitudinal beam includes:

a first longitudinal beam extending across the plurality of upstanding posts, the first longitudinal beam being spaced above the longitudinal barrier and disposed between the path of traffic and the plurality of panels, and a second longitudinal beam extending across the plurality of upstanding posts, the second longitudinal beam being spaced above the first longitudinal beam and disposed between the path of traffic and the plurality of panels.

4. The traffic noise barrier system of claim 3, wherein:

a center of the first longitudinal beam is spaced a first distance between about 32 inches to about 44 inches above a terrain surface; and a center of the second longitudinal beam is spaced a second distance between about 44 inches to about 74 inches above the terrain surface.

5. The traffic noise barrier system of claim 4, wherein the first distance is about 38 inches, and the second distance is about 60 inches.

6. The traffic noise barrier system of claim 3, further comprising:

a third longitudinal beam disposed between the path of traffic and the plurality of panels, the third longitudinal beam extending across the plurality of upstanding posts.

7. The traffic noise barrier system of claim 6, wherein:

a center of the first longitudinal beam is spaced a first distance between about 32 inches to about 44 inches above a terrain surface;

a center of the second longitudinal beam is spaced a second distance between about 44 inches to about 74 inches above the terrain surface; and a center of the third longitudinal beam is spaced a third distance between about 100 inches to about 154 inches above the terrain surface.

8. The traffic noise barrier system of claim 7, wherein the first distance is about 38 inches, and the second distance is 60 inches, and the third distance is about 128 inches.

9. The traffic noise barrier system of claim 6, wherein:

the longitudinal barrier has a height greater than or equal to 40 inches above a terrain surface and the first longitudinal beam is omitted.

10. The traffic noise barrier system of claim 1, wherein the longitudinal barrier includes:

a front surface facing the path of traffic, and a back surface opposite the front surface, the traffic noise barrier wall being attached to the longitudinal barrier at the back surface.

11. The traffic noise barrier system of claim 1, wherein the traffic noise barrier wall is entirely supported by the longitudinal barrier.

12. The traffic noise barrier system of claim 1, wherein at least one panel in the plurality of panels is transparent.

13. The traffic noise barrier system of claim 1, wherein the at least one panel is reinforced with plastic bands, plastic threads, or a plastic net.

14. The traffic noise barrier system of claim 13, wherein the plastic threads are high-contrast plastic threads, the high-contrast plastic threads having sufficient contrast to be recognized by birds flying in the vicinity of the panel and causing no substantial impairment of the overall transparency of the panel.

15. The traffic noise barrier system of claim 1, wherein each panel in the plurality of panels has a rigid frame disposed around at least a portion of its perimeter.

16. The traffic noise barrier system of claim 1, further comprising:

a rear support beam extending parallel to the first longitudinal beam and being disposed on an opposite side of the panel from the first longitudinal beam.

17. The traffic noise barrier system of claim 16, further comprising:

a front support beam attached to the first longitudinal beam and being disposed between the first longitudinal beam and the panel.

18. The traffic noise barrier system of claim 17, further comprising resilient members disposed between the front support beam and the panel and between the rear support beam and the panel.

19. The traffic noise barrier system of claim 1, wherein each of the upstanding posts has a flange extending along substantially an entire height of the upstanding post, the flange extending generally parallel to the panel to form a gap between opposing, generally parallel surfaces the flange and the panel, the gap being less than or equal to about ½ inch.

20. The traffic noise barrier system of claim 1, wherein each of the upstanding posts has a flange extending along substantially an entire height of the upstanding post, the flange extending generally parallel to the panel to form a gap between opposing, generally parallel surfaces the flange and the panel, the traffic noise barrier system further comprising:

an anti-intrusion wedge disposed within the gap.

21. A traffic noise barrier system for use alongside a path of traffic, the traffic noise barrier system comprising:

a longitudinal barrier extending substantially parallel to the path of traffic, the longitudinal barrier including:

a front surface facing the path of traffic, a back surface opposite the front surface, and a top surface adjacent to the front and back surfaces; and a traffic noise barrier wall attached to the back surface of the longitudinal barrier, the traffic noise barrier wall including:

a plurality of upstanding posts attached to the traffic noise barrier wall, at least one panel supported between each adjacent pair of posts in the plurality of upstanding posts, the at least one panel having spaced parallel faces and containing plastic threads, plastic bands or a plastic net embedded approximately midway between the parallel faces and extending parallel to the faces, and at least one longitudinal beam spaced above the top surface of the longitudinal barrier and extending across the plurality of upstanding posts for redirecting a portion of an errant vehicle away from the at least one panel.

22. The traffic noise barrier system of claim 21, wherein the plastic threads are high-contrast plastic threads, the high-contrast plastic threads having sufficient contrast to be recognized by birds flying in the vicinity of the panel and causing no substantial impairment of the overall transparency of the panel.

* * * * *